US005535490A

United States Patent [19]

Neth

[11] Patent Number: 5,535,490

[45] Date of Patent: Jul. 16, 1996

[54] CASKET SHIPPING CLIP

[75] Inventor: William F. Neth, Batesville, Ind.

[73] Assignee: Batesville Casket Company, Inc., Batesville, Ind.

[21] Appl. No.: 353,139

[22] Filed: Dec. 9, 1994

[51] Int. Cl.[6] ..... A61G 17/00

[52] U.S. Cl. ..... 27/1; 27/16; 292/341.12; 292/DIG. 73

[58] Field of Search ..... 27/1, 14, 16, 35, 27/DIG. 1; 16/DIG. 6; 292/DIG. 73, 288, 341.12

[56] References Cited

U.S. PATENT DOCUMENTS 2,621,962 12/1952 Jackson ..... 16/DIG. 6
4,597,427 7/1986 Anderson ..... 160/107

*Primary Examiner*—Kien T. Nguyen

*Attorney, Agent, or Firm*—Wood, Herron & Evans

[57] ABSTRACT

A shipping clip is provided for a casket which has a body or shell with a top ledge including a front edge and a pair of caps pivoted to the body and closable thereon, with each of the pair of caps having a header wall on an end thereof. The header walls are in a confronting relationship one to another when the pair of caps are closed upon the body. The shipping clip spaces the header walls from one another and spaces the caps from the body during shipping of the closed casket. The shipping clip comprises a base which has two side edges and which is adapted to be placed atop the top ledge of the casket body, a first wall extending upwardly from the base intermediate the base side edges, and second and third walls extending upwardly from the base, one of which is located on one side of the first wall and the other of which is located on the other side of the first wall. Each of the second and third walls are spaced from the first wall by an amount which provides for a snug fit of one of the cap header walls between the first and second walls and of the other cap header wall between the first and third walls.

25 Claims, 1 Drawing Sheet

CASKET SHIPPING CLIP

FIELD OF THE INVENTION

This invention relates generally to caskets, and more particularly to a shipping clip for a casket which maintains the casket caps spaced from one another and spaced from the casket shell or body during shipping of the closed casket.

BACKGROUND OF THE INVENTION

A traditional casket includes a lower casket body or shell, to which is pivoted a pair of casket caps, one on one end of the casket and the other on the other end of the casket, which are openable and closable upon the casket body. A latch is included for latching the casket caps in a closed position.

Normally, the latch mechanism of a casket does not eliminate all play between the caps relative to one another and to the casket body. Especially in the case of wood caskets, such play during shipping of the casket can result in the caps rubbing one another which damages the finish of the wood.

Currently, the caps are "banded down" to hold them in place during shipment. By "banded down", it is meant that steel or nylon bands encircle the caps and the casket body and are drawn tight and secured. Banding pads are positioned between the bands and the casket body and cap to prevent the bands from coming in direct contact with the casket. Not only does this technique of restraining the caps during shipping result in increased shipping costs, but once the bands and banding pads are removed the wood of the casket exhibits a dull mark where the banding pad resided, and especially on the surface of the caps. These marks are most notable in the finish of high gloss polished caskets. Special buffing, refinishing and the like must then be carried out at the point of destination to remove these unsightly marks.

It is therefore a main objective of the present invention to provide an improved technique of securing the casket caps during shipping which does not require the caps to be "banded down".

It is another objective of the present invention to provide a technique of securing the casket's caps during shipping which does not result in unsightly marks being left on the casket after the apparatus for securing the caps is removed at the point of destination.

SUMMARY OF THE INVENTION

The present invention attains the stated objectives by providing a shipping clip for a casket which has a body or shell with a top ledge including a front edge and a pair of caps pivoted to the body and closable thereon, with each of the pair of caps having a header wall on an end thereof. The header walls are in a confronting relationship one to another when the pair of caps are closed upon the body. The shipping clip spaces the header walls from one another and spaces the caps from the body during shipping of the closed casket. The shipping clip comprises a base which has two side edges and which is adapted to be placed atop the top ledge of the casket body, a first wall extending upwardly from the base intermediate the base side edges, and second and third walls extending upwardly from the base, one of which is located on one side of the first wall and the other of which is located on the other side of the first wall. Each of the second and third walls are spaced from the first wall by an amount which provides for a snug fit of one of the cap header walls between the first and second walls and of the other cap header wall between the first and third walls.

In a preferred form of the present invention, the space between each of the second and third walls and the first wall is about 0.750 inch, and the first wall is about 0.150 inch thick. This shipping clip is preferably fabricated of a resilient non-marring material, for example polypropylene. Each of the second and third walls preferably extend toward the first wall forming an angle with the base of less than 90°, and preferably the angle is about 45°.

The clip preferably includes a fourth wall which extends downwardly from the base and which is adapted to be abutted against the front edge of the top ledge of the casket body.

In order to completely remove any upward and downward play from the caps when the casket latch latches the caps in the closed position, the shipping clip base is preferably of a thickness which requires slight compression of the base by the caps to activate the latch thereby removing such play. In the preferred form, the base thickness is about 0.150 inch thick.

One advantage of the present invention is that caskets may be shipped with their caps secured so as to not rub against one another without having to use bands and banding pads to "band down" the caps during shipment of the casket.

Another advantage of the present invention is that no marks are made on the exterior surfaces of the casket by securing the caps for shipment of the casket.

Yet another advantage of the present invention is that the invention prevents all movement of the casket caps during shipment.

These and other objects and advantages of the present invention will become more readily apparent during the following detailed description taken in conjunction with the drawings herein, in which:

DETAILED DESCRIPTION OF THE INVENTION

Figure 1:
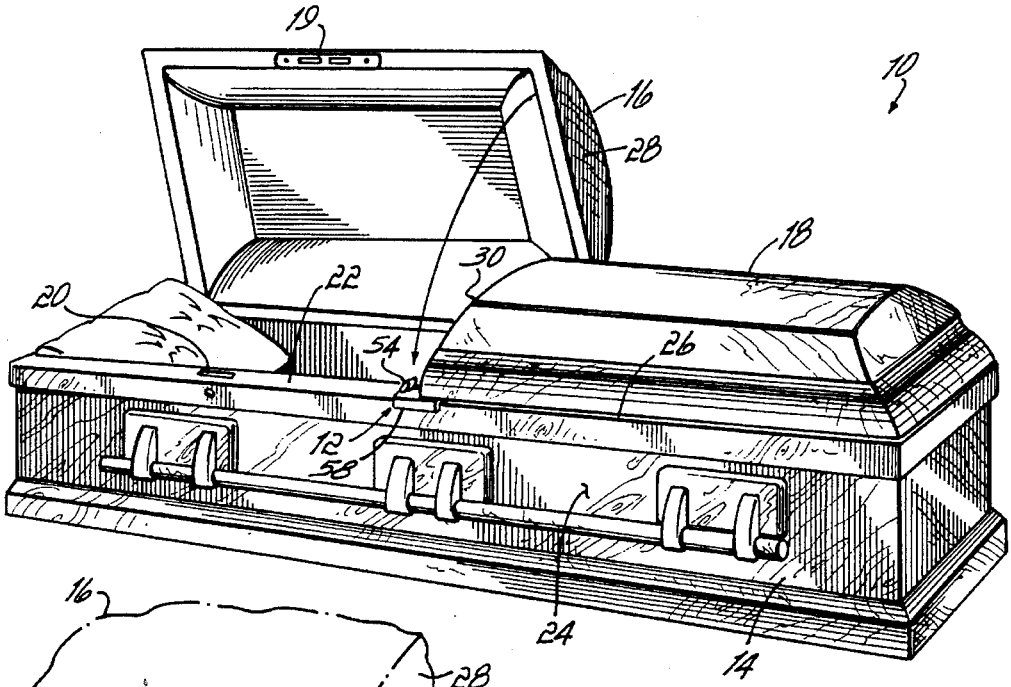
FIG. 1 is a perspective view of a wooden casket including the shipping clip of the present invention.

Referring first to FIG. 1, there is illustrated a casket 10 in conjunction with a shipping clip 12 incorporating the principles of the present invention. The casket 10 includes a lower shell or body 14, a head cap 16 pivoted to the head end of the body 14, and a foot cap 18 pivoted to the foot end of the body 14. A locking mechanism 20, known to those skilled in the art, is included in body 14 and is operable to lock or latch the caps 16 and 18 atop the body 14, each of which includes cooperating latching structure 19 known to those skilled in the art for cooperating with the lock or latch 20 to effect its latching.

Figure 2:
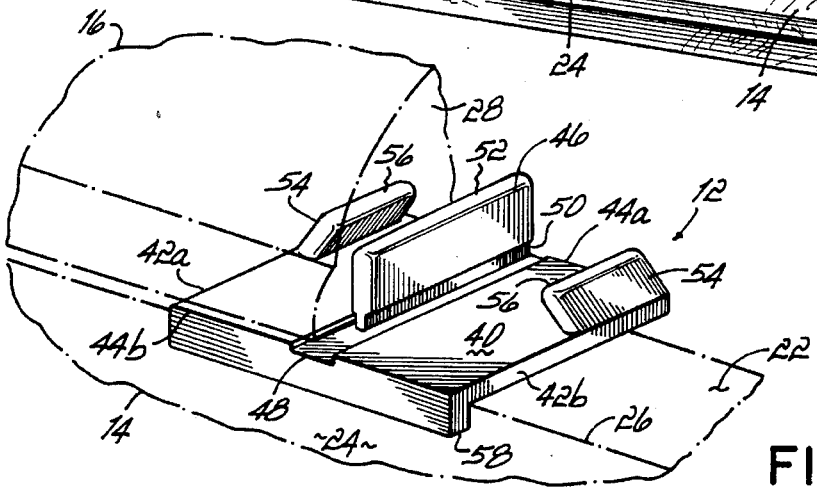
FIG. 2 is a perspective view, greatly enlarged, of the shipping clip atop the top ledge of the casket body and with the head cap in phantom closed thereon.

Referring now to FIG. 2, the shipping clip 12 of the present invention is shown residing atop the top ledge 22 of the front wall 24 of the body 14. Top ledge 22 includes a front edge 26. Cap 16 (phantom) includes a header wall 28 on the foot end thereof. Similarly, foot end cap 18 includes a header wall 30 on its head end (FIG. 3).

Figure 3:
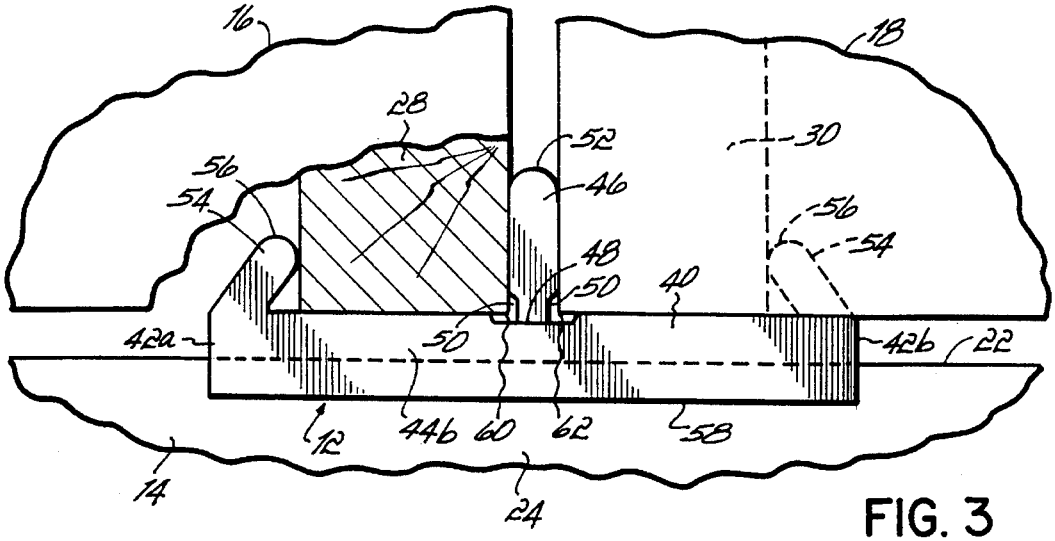
FIG. 3 is a front elevation view of the top ledge of the casket with shipping clip thereatop and with both caps in their closed position.

Referring now to FIGS. 2 and 3, the shipping clip 12 includes a base 40 including side edges 42*a*, 42*b* and end edges 44*a*, 44*b*. The clip is approximately 2.250 inches wide (across edges 42*a*, 42*b*) by 2.150 inches tall (across edges 44*a*, 44*b*). A generally vertically oriented separator wall 46 extends upwardly from the base 40 by approximately 0.500 inch, originating in a shallow channel 48 approximately 0.010 inch deep and 0.270 inch wide. The lateral sides of the separator wall 46 are relieved in a lowermost position as shown at 50 by approximately 0.010 inch in thickness for approximately 0.060 inch in height above the upper surface of base 40 for a purpose which will be subsequently described. The upper edge 52 of separator wall 46 is radiused. A pair of wing walls 54, 54 extend upwardly from the base 40. One of the wing walls 54 is located on one side of the separator wall 46 and the other wing wall 54 is located on the other side of the separator wall 46. In a preferred embodiment illustrated in the drawings, the wing walls 54, 54 extend upwardly and inwardly from the lateral edges 42*a*, 42*b* of the shipping clip 12. The top edge 56 of each wing wall 54 is radiused like that of the separator wall 46. Separator wall 46 is approximately 1.650 inches long and commences from top end edge 44*a*. Wing walls 54, 54 likewise commence at top end edge 44*a* and are approximately 0.875 inch long. Further preferably, wing walls 54, 54 angle toward the separator wall 46 at an angle of approximately 45° relative to base 40. Separator wall 46 extends upward from the upper surface of base 40 by approximately 0.500 inch, whereas wing walls 54, 54 extend upwardly from the upper surface of base 40 by approximately 0.250 inch.

A lip 58, approximately 0.150 inch high (measured downward from the upper surface of base 40) and 0.150 inch thick, projects downwardly from the bottom end edge 44*b* of shipping clip 12. Base 40 resides atop the top ledge 22, while lip 58 is biased or abutted against the front edge 26 of the top ledge 22. The base 40, separator wall 46 and wing walls 54, 54 are all preferably 0.150 inch thick. The separator wall 46 and each wing wall 54 are spaced to provide a space of approximately 0.750 inch between them. As is seen in FIGS. 2 and 3, header wall 28, of head end cap 16, is received between the separator wall 46 and one of the wing walls 54. The shipping clip, fabricated of a resilient, non-marring material, for example polypropylene, provides for resilient retention of the header wall 28 of head end cap 16 and header wall 30 of foot end cap 18 between respective ones of the wing walls 54, 54 and separator wall 46 by virtue of the angled orientation of the wing walls 54, 54, the resiliency of the material, and the spacing between the wing walls 54, 54 and separator wall 46. Further, the natural flexing of the 45° wing walls 54, 54 is accommodating to manufacturing variations of header wall thickness. In order to take all upward and downward play out of the caps 16 and 18 after the latching mechanism 20 is latched, the base 40 is of a thickness which requires slight compression of the base 40 by caps 16 and 18 to completely activate the latch 20 in latching or locking the caps 16 and 18 in their closed positions. As described above, the thickness of the base 40 is preferably approximately 0.150 inch.

Referring to FIG. 3, it will be seen that the combination of the shallow channel 48 in combination with the relieved areas 50, 50 at the lower ends of the sides of the separator wall 46 provide clearance for the corners 60, 62 of the head end cap 16 and foot end cap 18, respectively. Thus, use of the clip 12 will not damage or in any way alter the square edge of the header walls 28 and 30.

In use, the caps 16 and 18 are opened, and the clip 12 is placed atop the top ledge 22 and moved laterally inwardly until the lip 58 abuts the front edge 26. The caps 16 and 18 are then lowered to their closed position, and in doing so header wall or board 28 of head end cap 16 is captured between separator wall 26 and one of the wing walls 54, whereas the header wall or board 30 of the foot end cap 18 is captured between the separator wall 46 and the other wing wall 54. The header boards are separated by the thickness of the separator wall 46. The corner edges 60 and 62 of the header walls 28 and 30 are accommodated by the shallow channel 48 in combination with the relieved areas 50, 50 of separator wall 46. Next the latch 20 is latched to latch or lock the caps 16 and 18 in their closed position. As slight compression of the base 40 is required to activate the latch 20, all vertical or upward and downward play of the caps 16 and 18 is eliminated. Moreover, the caps 16 and 18 cannot come into contact with one another during shipping by virtue of the separator wall 46 and wing walls 54, 54. Alternatively, the clip 12 can be installed directly onto the caps 16 and 18 when in their open positions, as the separator wall 46 and wing walls 54, 54 snugly grasp the header walls 28 and 30 of the caps 16 and 18, respectively. The tooling for making the clip 12 is preferably constructed so that parting lines occur on the outside edges 42*a*, 42*b* of the clip, thus away from any contact with the finished casket wood surfaces.

Those skilled in the art will readily recognize numerous adaptations and modifications which can be made to the casket shipping clip of the present invention which will result in an improved shipping clip, yet all of which will fall within the spirit and scope of the present invention as defined in the following claims. Accordingly, the invention is to be limited only by the scope of the following claims and their equivalents.

What is claimed is:

1. For use in a casket having a body with a top ledge including a front edge and a pair of caps pivoted to the body and closeable thereupon, each of the pair of caps having a header wall on an end thereof, the header walls being in a confronting relationship one to another when the pair of caps are closed upon the body, a shipping clip for spacing the header walls from one another and for spacing the caps from the body during shipping of the closed casket, said shipping clip comprising:

a base having a length, a width, two side edges and two end edges and being adapted to be placed atop the top ledge of the casket body;

a first wall extending upwardly from said base intermediate said base side edges;

second and third walls extending upwardly from said base, one of which is located on one side of said first wall and the other of which is located on the other side of said first wall;

each of said second and third walls being spaced from said first wall by an amount which provides for a snug fit of one cap header wall between said first and second walls and of the other cap header wall between said first and third walls.

2. The shipping clip of claim 1 wherein the space between each of said second and third walls and said first wall is about 0.750 inch.

3. The shipping clip of claim 1 wherein said first wall is about 0.150 inch thick.

4. The shipping clip of claim 1 wherein said clip is fabricated from resilient material.

5. The shipping clip of claim 4 wherein said material is polypropylene.

6. The shipping clip of claim 4 wherein each of said second and third walls extend toward said first wall forming an angle with said base of less than 90°.

7. The shipping clip of claim 6 wherein said angle is about 45°.

8. The shipping clip of claim 1 wherein said clip includes a fourth wall extending downwardly from said base which is adapted to be abutted against the front edge of the top ledge of the casket body.

9. The shipping clip of claim 1, the casket having a latch for latching the caps in their closed position, wherein said shipping clip base is of a thickness which requires slight compression of said base by the caps to activate the latch thereby removing any upward and downward play from the caps.

10. The shipping clip of claim 9 wherein said base is about 0.150 inch thick.

11. For use in a casket having a body with a top ledge including a front edge and a pair of caps pivoted to the body and closeable thereupon, each of the pair of caps having a header wall on an end thereof, the header walls being in a confronting relationship one to another when the pair of caps are closed upon the body, a shipping clip for spacing the header walls from one another and for spacing the caps from the body during shipping of the closed casket, said shipping clip comprising:

a base having a length, a width, two side edges and two end edges and being adapted to be placed atop the top ledge of the casket body;

a generally vertical separator wall extending upwardly from said base intermediate said base side edges;

a pair of wing walls extending upwardly from said base, one of which is located on one side of said separator wall and the other of which is located on the other side of said separator wall, said wing walls being angled toward said separator wall;

each of said wing walls being spaced from said separator wall by an amount which provides for a snug fit of one cap header wall between said separator wall and one said wing wall and of the other cap header wall between said separator wall and the other said wing wall.

12. The shipping clip of claim 11 wherein said clip is fabricated of polypropylene.

13. The shipping clip of claim 11 wherein the space between each of said wing walls and said separator wall is about 0.750 inch.

14. The shipping clip of claim 11 wherein said separator wall is about 0.150 inch thick.

15. The shipping clip of claim 11 wherein each of said wing walls form an angle of about 45° with said base.

16. The shipping clip of claim 11 wherein said clip includes a lip extending downwardly from said base which is adapted to be abutted against the front edge of the top ledge of the casket body.

17. The shipping clip of claim 11, the casket having a latch for latching the caps in their closed position, wherein said shipping clip base is of a thickness which requires slight compression of said base by the caps to activate the latch thereby removing any upward and downward play from the caps.

18. The shipping clip of claim 17 wherein said base is about 0.150 inch thick.

19. For use in a casket having a body with a top ledge including a front edge, a pair of caps pivoted to the body and closeable thereupon and a latch for latching the caps in their closed position, each of the pair of caps having a header wall on an end thereof, the header walls being in a confronting relationship one to another when the pair of caps are closed upon the body, a polypropylene shipping clip for spacing the header walls from one another and for spacing the caps from the body during shipping of the closed casket, said shipping clip comprising:

a base having a length, a width, two side edges and two end edges and being adapted to be placed atop the top ledge of the casket body;

a generally vertical separator wall extending upwardly from said base intermediate said base side edges;

a pair of wing walls extending upwardly from said base, one of which is located on one side of said separator wall and the other of which is located on the other side of said separator wall, said wing walls being angled toward said separator wall;

a lip extending downwardly from said base which is adapted to be abutted against the front edge of the top ledge of the casket body;

each of said wing walls being spaced from said separator wall by an amount which provides for a snug fit of one cap header wall between said separator wall and one said wing wall and of the other cap header wall between said separator wall and the other said wing wall;

said shipping clip base being of a thickness which requires slight compression of said base by the caps to activate the latch thereby removing any upward and downward play from the caps.

20. The shipping clip of claim 19 wherein the space between each of said wing walls and said separator wall is about 0.750 inch.

21. The shipping clip of claim 19 wherein said separator wall is about 0.150 inch thick.

22. The shipping clip of claim 19 wherein each of said wing walls form an angle of about 45° with said base.

23. A combination comprising a casket having a body with a top ledge including a front edge and a pair of caps pivoted to said body and closeable thereupon, each of said pair of caps having a header wall on an end thereof, said header walls being in a confronting relationship one to another when said pair of caps are closed upon said body, and a shipping clip for spacing said header walls from one another and for spacing said caps from said body during shipping of said closed casket, said shipping clip comprising:

a base having a length, a width, two side edges and two end edges placed stop said top ledge of said casket body;

a first wall extending upwardly from said base intermediate said base side edges;

second and third walls extending upwardly from said base, one of which is located on one side of said first wall and the other of which is located on the other side of said first wall;

each of said second and third walls being spaced from said first wall by an amount which provides for a snug fit of one cap header wall between said first and second walls and of the other cap header wall between said first and third walls.

24. A combination comprising a casket having a body with a top ledge including a front edge and a pair of caps pivoted to said body and closeable thereupon, each of said pair of caps having a header wall on an end thereof, said header walls being in a confronting relationship one to another when said pair of caps are closed upon said body, and a shipping clip for spacing said header walls from one another and for spacing said caps from said body during shipping of said closed casket, said shipping clip comprising:

a base having a length, a width, two side edges and two end edges placed atop said top ledge of said casket body;

a generally vertical separator wall extending upwardly from said base intermediate said base side edges;

a pair of wing walls extending upwardly from said base, one of which is located on one side of said separator wall and the other of which is located on the other side of said separator wall, said wing walls being angled toward said separator wall;

each of said wing walls being spaced from said separator wall by an amount which provides for a snug fit of one cap header wall between said separator wall and one said wing wall and of the other cap header wall between said separator wall and the other said wing wall.

25. A combination comprising a casket having a body with a top ledge including a front edge, a pair of caps pivoted to said body and closeable thereupon and a latch for latching said caps in their closed position, each of said pair of caps having a header wall on an end thereof, said header walls being in a confronting relationship one to another when said pair of caps are closed upon said body, and a polypropylene shipping clip for spacing said header walls from one another and for spacing said caps from said body during shipping of said closed casket, said shipping clip comprising:

a base having a length, a width, two side edges and two end edges placed atop said top ledge of said casket body;

a generally vertical separator wall extending upwardly from said base intermediate said base side edges;

a pair of wing walls extending upwardly from said base, one of which is located on one side of said separator wall and the other of which is located on the other side of said separator wall, said wing walls being angled toward said separator wall;

a lip extending downwardly from said base abutted against said front edge of said top ledge of said casket body;

each of said wing walls being spaced from said separator wall by an amount which provides for a snug fit of one cap header wall between said separator wall and one said wing wall and of the other cap header wall between said separator wall and the other said wing wall;

said shipping clip base being of a thickness which requires slight compression of said base by said caps to activate said latch thereby removing any upward and downward play from said caps.

* * * * *